US006003496A

United States Patent [19]

Maloney

[11] Patent Number: 6,003,496

[45] Date of Patent: Dec. 21, 1999

[54] TRANSIENT FUEL COMPENSATION

[75] Inventor: Peter James Maloney, New Hudson, Mich.

[73] Assignee: General Motors Corporation, Detroit, Mich.

[21] Appl. No.: 09/160,954

[22] Filed: Sep. 25, 1998

[51] Int. Cl.[6] ..... F02M 51/00

[52] U.S. Cl. ..... 123/480

[58] Field of Search ..... 123/480, 492

[56] References Cited

U.S. PATENT DOCUMENTS

| | | | |
|---|---|---|---|
| 5,494,019 | 2/1996 | Ogawa | 123/480 |
| 5,586,544 | 12/1996 | Kitamura et al. | 123/480 |
| 5,701,871 | 12/1997 | Munakata et al. | 123/480 |
| 5,806,012 | 9/1998 | Maki et al. | 123/480 |
| 5,832,901 | 11/1998 | Yoshida et al. | 123/480 |
| 5,868,118 | 2/1999 | Yoshioka | 123/480 |
| 5,893,039 | 4/1999 | Pfefferle | 123/480 |

*Primary Examiner*—John Kwon
*Attorney, Agent, or Firm*—Vincent A. Cichosz

[57] ABSTRACT

Transient internal combustion engine fueling control with reduced calibration burden and increased precision through application of a convection model to estimate the mass transfer of fuel between cylinder intake gasses and intake system components primarily as a function of fuel film temperature and gas flow across fuel film on such components. The convection model applies potential/flow conditions in proximity to fuel film on intake components of an engine cylinder to predict the depletion of the fuel film and generates an impact factor representing the fraction of injected fuel impacting intake system components in a manner providing fuel control stability. The convection model applies an intake valve temperature estimate generated simply as a function of air mass flow rate through the intake system to be used in the calculation of the film convection parameters.

11 Claims, 3 Drawing Sheets

TRANSIENT FUEL COMPENSATION

TECHNICAL FIELD

This invention relates to internal combustion engine control and, more particularly, to improved engine air/fuel ratio control under transient operating conditions.

BACKGROUND OF THE INVENTION

Ambitious automotive internal combustion engine emissions, fuel economy and performance goals require precise control of the ratio of air to fuel available for consumption in engine cylinders. Precise air/fuel ratio control requires compensation for fueling lags associated with the fuel injection system, including fueling lags caused by fuel film build-up on engine cylinder intake system components, such as valve poppets and intake passage walls. For a given fuel injection event, a portion of the fuel injected into a cylinder intake runner (passage) leading to an engine cylinder impacts the walls and intake valve poppet, leading to an accumulation or mass transfer of fuel film to such intake system components. That fuel film gradually depletes and is drawn, along with later injected fuel, into the engine cylinder during subsequent cylinder intake events, for combustion therein. The mass of fuel transferred to the intake system components and the time rate of depletion of that fuel is conventionally modeled as a boiling process.

For a given engine application, a substantial number of calibration parameters are required to account for the fuel mass transfer under the boiling process model. The need for a large set of calibration parameters is mainly due to the non-physical, weak relationship between the independent variables (i.e. intake manifold pressure and coolant temperature) used to schedule the parameters and the actual conditions occurring in the engine intake system. Accordingly, a significant amount of time is required to model the fuel mass transfer process each time an engine or engine intake system is changed, adding significant lead time and cost to engine development. Additionally, due to the lack of a clear underlying theory of parameter behavior, calibration parameter results vary significantly between applications due to differences in the approaches and expectations of calibration personnel.

It would therefore be desirable to provide a simplified model of the mass transfer process for transient internal combustion engine cylinder fueling control that accurately models the mass build-up and depletion of fuel film on the intake system, to provide for accurate control with reduced calibration burden.

SUMMARY OF THE INVENTION

The present invention is directed to improved transient fueling control in internal combustion engines with precise modeling of fuel film build-up and depletion on intake system components with minimum calibration burden.

More specifically, the mass transfer of fuel from cylinder intake system components, such as intake runner walls or poppets to the cylinder is not modeled according to the conventional boiling process model, but rather according to a convection model, with the time rate of change in fuel film mass determined as a function of the temperature of the fuel film surface and of gas flow conditions across the fuel film. The gas flow conditions may be represented by the flow rate of gasses across the fuel film, the gas flow temperature in proximity to the fuel film, and the air pressure at the fuel film. The gas flowing across the fuel film is a combination of air, fuel vapor, and recirculated engine exhaust gasses.

In accordance with a further aspect of this invention, by deviating fundamentally from the conventional boiling mass transfer assumption, several simplifications to the modeling process are possible, providing for a transient fuel mass transfer estimation that reduces significantly the calibration burden in the engine development process. In accordance with a further aspect of this invention, the fuel mass transfer is compensated for in a manner providing a substantial degree of control stability, by insuring that the compensator impact fraction parameter conservatively deviates from the actual fraction of total injected fuel that impacts existing fuel film under less than ideal dynamic compensation conditions.

BRIEF DESCRIPTION OF THE DRAWINGS

The invention may be best understood by reference to the preferred embodiment and to the drawings in which.

DESCRIPTION OF THE PREFERRED EMBODIMENT

Figure 1:
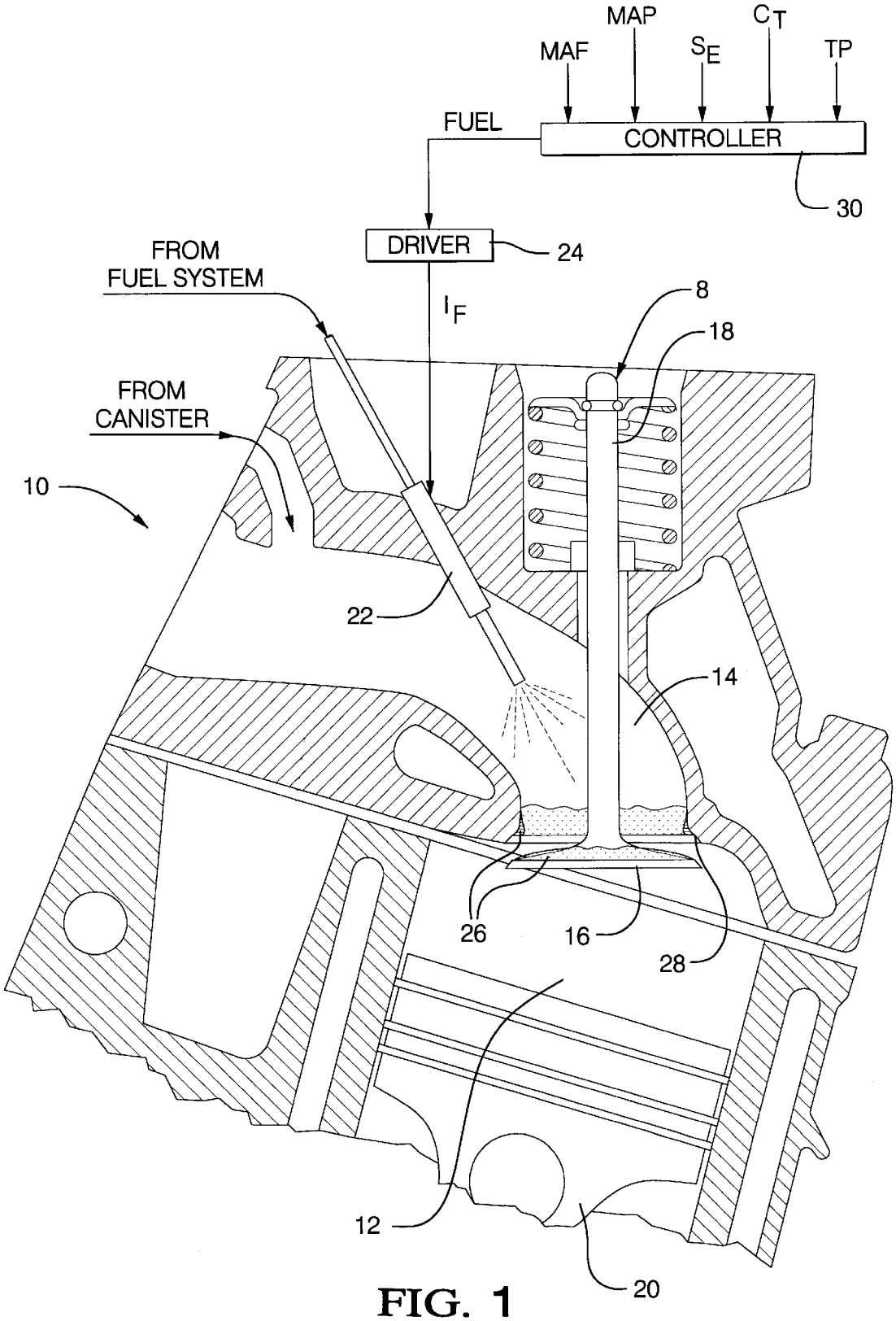
FIG. 1 is a general diagram of an engine system in which the principles of this invention are applied in accordance with the preferred embodiment.

Referring to FIG. 1, a portion of a conventional internal combustion engine 10 is illustrated including a cylinder 12 in which is reciprocally driven a piston 20, and an intake system through which a mixture of fuel and air pass into the cylinder 12. The intake system includes an intake passage 14 through which intake air passes from an intake plenum (not shown) and into which fuel, such as gasoline is injected in a port injection process via standard fuel injector 22 in response to a fueling command $i_f$, an intake port 28 and an intake valve 8 having a stem 18 mechanically coupled to a valve poppet 16 which seals against the port 28 in an upward closed position and opens into the cylinder 12 during a cylinder intake event to allow an air-fuel mixture to enter the cylinder. Fuel vapor is released from a standard fuel vapor canister (not shown) and into the intake passage 14 for delivery to the engine cylinder 12.

The fuel enters the cylinder in the form of droplets of fuel and fuel vapor. Some of the droplets enter the engine cylinder across the intake port, and other droplets impact and are retained on the valve poppet 16 and walls of the intake port 28 as fuel film 26. The vapor from the injected fuel merges with the fuel vapor from the vapor canister (not shown) and vapor leaving the fuel film 26 and enters the cylinder 12 for combustion therein. The fuel film builds up on tip-in transients in which cylinder mass airflow rate and the corresponding fueling rate are rapidly increasing, creating fueling lag in which the mass of fuel reaching the cylinder 12 for combustion therein is less than the fuel mass corresponding to fuel command $i_f$. The fuel film is depleted on tip-out transients in which cylinder air mass flow rate and the corresponding fueling rate are rapidly decreasing, creating an overfueling error in which the mass of fuel reaching the cylinder 12 for combustion therein exceeds the fuel mass corresponding to fuel command $i_f$. The fueling lag and overfueling error both contribute to air/fuel ratio control error, which may lead to increased engine out emissions, and reduced engine performance, especially in low temperature operating conditions.

Controller 30, in the form of a standard microcontroller having such well-known elements (not shown) as a central processing unit, read only memory devices, random access memory devices, and input/output devices, receives a plurality of input signals from conventional transducers and processes the input signals and, through execution of sequences of instructions stored in read only memory devices, provides for engine control and diagnostics and issues control and diagnostic output signals of a conventional type, including command signal FUEL in the form of a pulse width modulated signal the pulse width of which corresponds to the time of opening of injector 22, as is generally known in the art. The input signals received by the controller 30, via its input/output devices include signal MAF indicating mass airflow rate through the intake plenum (not shown) from a standard hot wire or thick film transducer across an engine intake air path (not shown), MAP indicating absolute air pressure in the intake plenum from a standard pressure transducer disposed in the intake plenum, Se indicating a rate of rotation of an engine crankshaft (not shown) from a standard Hall effect, variable reluctance or magnetoresistive device (not shown) disposed adjacent the crankshaft, Ct indicating engine coolant temperature from a conventional thermistor or thermocouples disposed within an engine coolant circulation path, and TP indicating displacement of an engine intake air valve away from a full restriction position. The operations carried out by the controller 30 include operations to estimate, and compensate for the time rate of change in fuel film mass on the intake system of FIG. 1 and to apply the estimated time rate of change in a precise fuel control procedure with reduced calibration complexity in accord with an important aspect of this invention. Such operations are illustrated in FIGS. 2 and 3.

Figure 2:
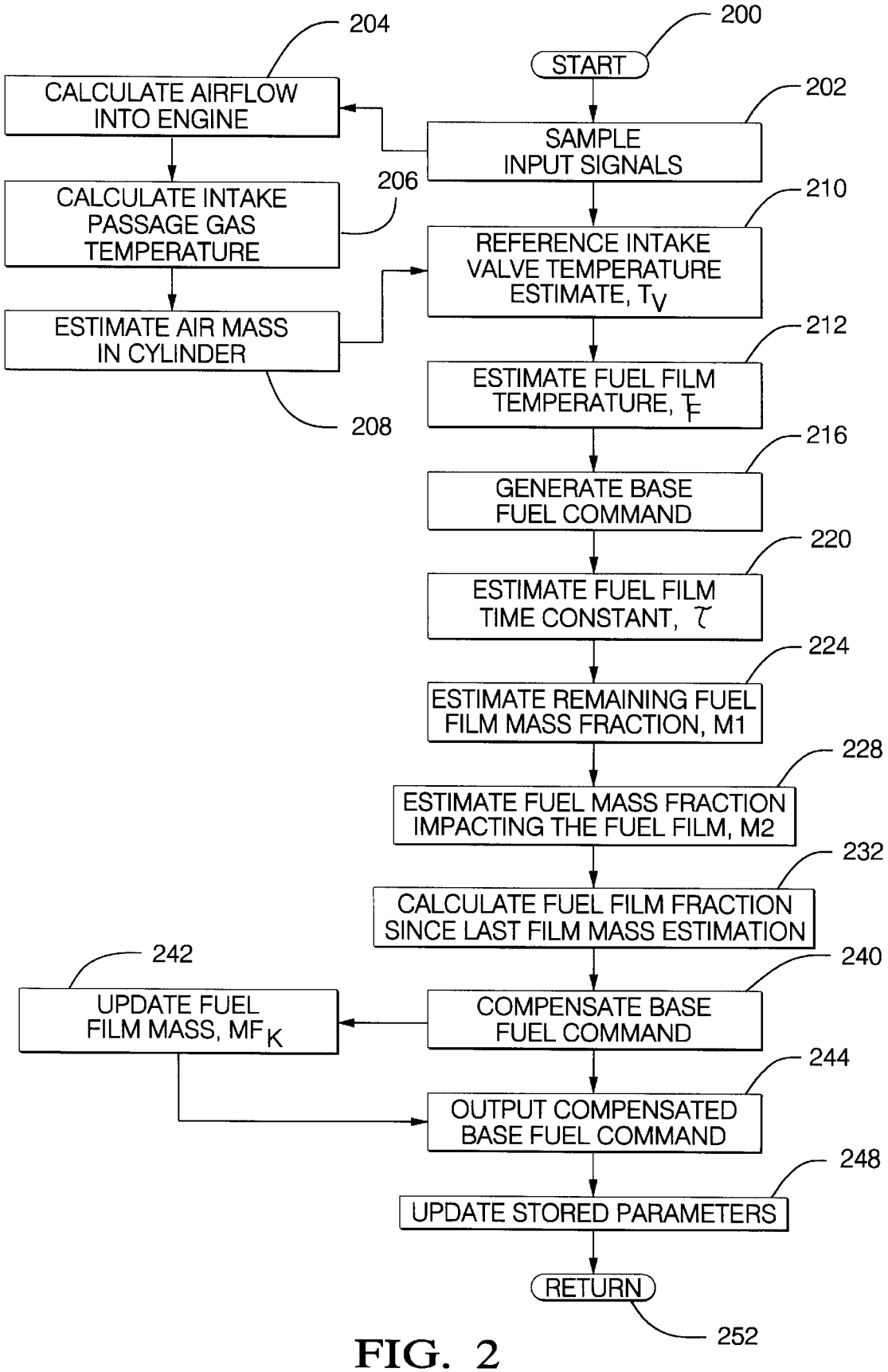
FIGS. 2 and 3 are computer flow diagrams illustrating a series of engine air/fuel ratio control operations for controlling the engine system of FIG. 1.
Figure 3:
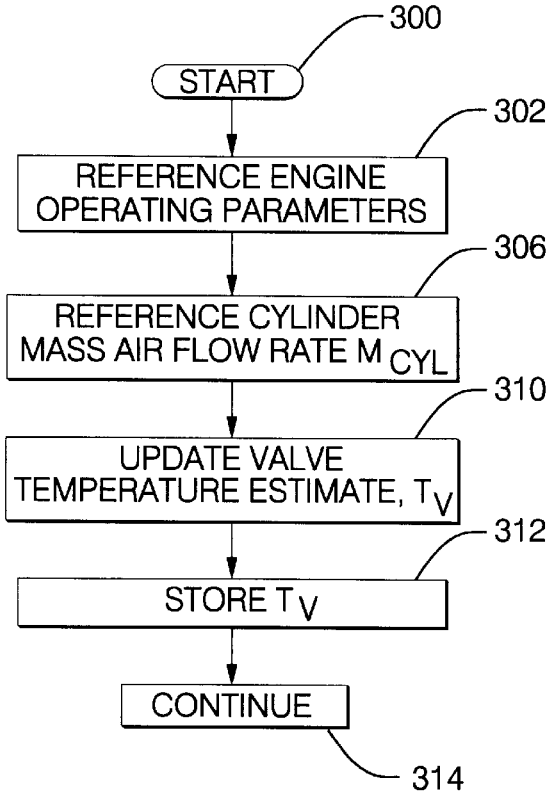

Referring to FIG. 2, engine fueling control operations for generating and correcting a cylinder fuel command are set forth in a step by step manner, implemented in the form of a sequence of software instructions stored in a standard read only memory device in the controller 30 of FIG. 1. The engine fueling control operations of FIG. 2 are to be executed periodically while the engine 10 of FIG. 1 is operating to generate a commanded mass of fuel to be admitted to a next active engine cylinder to provide for a desired engine cylinder air/fuel ratio, such as the stoichiometric ratio. The operations of FIG. 2 may be initiated upon occurrence of an event-based controller 30 interrupt, such as a standard interrupt that occurs each time an engine cylinder passes through a predetermined position, such as the top dead center position. Upon occurrence of each such interrupt, the operations of FIG. 2 are initiated at a step 200 and proceed to sample, at a next step 202, any input signals needed for carrying out the operations of FIG. 2, including, without limitation, input signals Se, MAP, MAF, Tc, and TP. The sampled input signals are filtered and processed in a suitable conventional manner so as to represent corresponding engine parameters.

After sampling, filtering and processing the input signals, airflow into the engine is estimated at a next step 204 through any suitable conventional airflow estimation approach, and preferably through execution of the pneumatic state estimation operations set forth in U.S. Pat. No. 5,753,805 assigned to the assignee of this application and hereby incorporated herein by reference. More specifically, through execution of the state estimation operations disclosed in this incorporated patent, a flow rate of gasses at the intake port is determined. This flow rate estimate is to intended to be applied as the combined engine airflow and EGR flow rate estimation of step 204.

Following the step 204, the temperature of gasses flowing through the intake passage of the current active cylinder (which is the cylinder next to undergo a fuel injection event) is estimated at a step 206. The temperature estimate may be provided in any suitable conventional manner, and preferably through the approach set forth in the copending U.S. patent application Ser. No. 08/862,074, filed May 22, 1997, assigned to the assignee of this application and hereby incorporated herein by reference. More specifically, through execution of the thermal state estimation operations set forth in the copending incorporated reference, gas temperature at an intake runner end adjacent the cylinder inlet is estimated. Such estimated temperature at the intake runner end is intended as the temperature estimation provided at the step 206.

Following the temperature estimation of step 206, air mass trapped in the next active engine cylinder is calculated at a step 208 as a product of the airflow determined at the step 204 and 120, divided by current engine speed Se. An intake valve temperature estimate Tv is next referenced at a step 210 from a standard random access memory device (not shown) of controller 30 of FIG. 1. The temperature estimate is periodically updated through the operations of FIG. 3, to be described. The estimate Tv is next applied at a step 212 to estimate temperature of the fuel film Tf in the intake passage of the current active engine cylinder, such as fuel film 26 of FIG. 1. In this embodiment, the temperature of the fuel film Tf is assumed to rapidly approach the temperature Tv of the intake valve poppet 16 such that Tv is assumed to reasonably represent Tf. In other embodiments of this invention, a temperature estimator, including a model of the fuel film temperature as a function of air temperature, intake valve poppet 16 temperature, air mass flow rate, and intake system temperature may be used to more accurately estimate fuel film temperature, for example through any suitable conventional modeling techniques generally known to those possessing ordinary skill in the art to which this invention pertains.

After estimating Tf, a base fuel command is generated at a next step 216 through conventional closed-loop fueling control operations whereby an open-loop fuel command generated as a function of the cylinder air mass value provided through step 208, is adjusted in response to a feedback signal representing fueling error and in response to learned closed-loop fueling correction information as may be stored in a non-volatile random access memory device (not shown) of controller 30 of FIG. 1. The base fuel command represents a closed-loop fueling command for providing a desired cylinder air/fuel ratio for the current operating conditions, including the current engine cylinder mass airflow rate from step 208.

As discussed, a fraction of the fuel delivered to an engine cylinder intake passage such as passage 14 of FIG. 1 accumulates temporarily on surfaces of the intake air system as fuel film and does not reach the cylinder 12 for combustion therein in a timely manner. As such, a significant difference exists between commanded fuel mass and fuel mass received in an active engine cylinder. The time rate of change in such fuel film mass is represented by a first-order system with fuel film time constant $\tau$, which, for the current operating conditions is next estimated at a step 220. In this invention, the fuel film time constant is related to the physically justified independent variables of the fuel film temperature, intake runner mass flow rate, intake manifold pressure, and intake runner gas temperature with a simple, compact relationship which requires only one calibration constant. This approach uses chemical engineering principles to relate the time constant $\tau$ to the independent variables in a very specific fashion, which simplifies calibration in relation to conventional approaches that require an array of calibration parameters to be determined with no underlying theory or expected results. Furthermore, the theoretical relationship facilitates the extrapolation of results from the conditions that occurred under test to other conditions in application. More specifically, in accordance with an essential aspect of this invention, the time constant $\tau$ is generated with a high degree of accuracy and with reduced calibration burden as a function of convection mass transfer conditions in proximity to the fuel film using the relationship between convection mass transfer characteristics of fuel and flow conditions in the intake system of the cylinder 12 (FIG. 1) as follows:

$$\frac{1}{\tau} = K_0 \cdot \dot{m}_{air}^{0.83} \cdot T_{air}^{0.44} \cdot P_{air}^{-0.44} \cdot T_f^{-1} \cdot e^{-cc/Tf} \quad (1)$$

which is an expansion of the simple potential/flow form of the following equation expressing the fuel film mass time-constant as a function of the convection conditions around the fuel film in the intake system:

$$\frac{1}{\tau} = \frac{A}{M_f} \cdot MW_{fuel} \cdot h_D \cdot (c_0 - c_\infty)$$

in which $K_0$ is a single calibration coefficient to be fit through a conventional in auto-tuning procedure, primarily related to the unknown mass to area relationship and average diffusivity of the fuel film, $m_{air}$ is air mass flow rate over the fuel film in the area of the cylinder intake port 28 (FIG. 1), $T_{air}$ is intake air temperature in proximity to the intake port 28, $P_{air}$ is absolute air pressure in proximity to the intake port 28, and $T_f$ is the estimated fuel film temperature as determined at the step 212 of FIG. 2, cc is a coefficient generally available in the art, related to the saturated vapor pressure of fuel, $M_f$ is fuel film mass, $MW_{fuel}$ is the molecular weight of fuel, $h_D$ is the mass transfer coefficient relating molar flow rate to chemical concentration, $C_0$ is the concentration of the fuel film at its surface, and $c_\infty$ is the concentration of fuel in the surroundings of the fuel film.

Equation 1 predicts that the fuel film time constant, representing the time rate of change in fuel film mass, should decrease with air mass flow rate as indicated by signal MAF, increase with pressure in the intake manifold of the engine as indicated by signal MAP, and decrease with fuel film temperature $T_f$. Returning to FIG. 2, after determining the time constant $\tau$ at the step 220, a discrete representation of the time constant is applied to determine, directly from application of digital control theory principles, the remaining fuel film mass fraction on the intake system of the current active engine cylinder, such as cylinder 14 of FIG. 1, from the prior cylinder intake event, termed M1, as follows:

$$M1 = e^{-120/Ser}.$$

Figure 4:
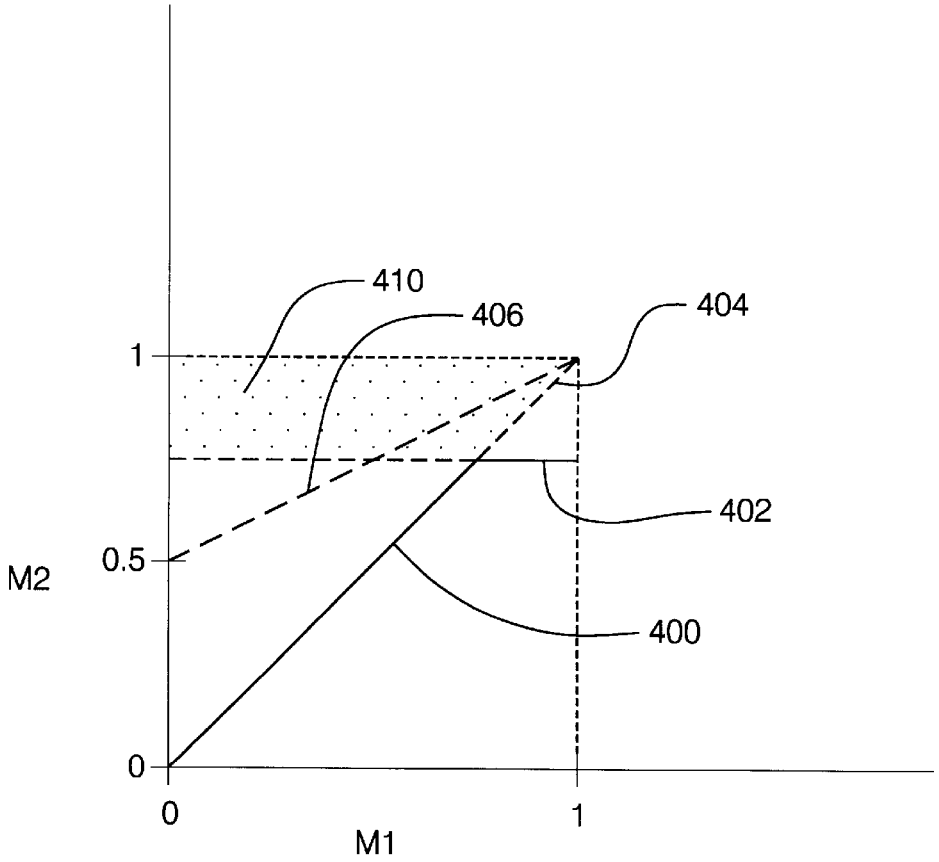
FIG. 4 is a two-dimensional calibration diagram illustrating a relationship between calibration parameters applied in the execution of the operations of FIGS. 2–3.

The mass fraction of injected fuel that impacts the existing fuel film on the port 28 and valve poppet 16 of FIG. 1, such as fuel film 26 of FIG 1, termed the impact fraction M2, is next determined at a step 228. Experimental results indicate the M2 does not vary significantly under different engine operating conditions in port sequential fuel injection applications, and would therefore ideally have a fixed value under all conditions. In practical applications, however, the digital transient fuel compensator is not fast enough to perfectly cancel the dynamics of the physical fuel film when those film dynamics are fast. Trying to do so will result in compensator instability, as is generally known to those skilled in the art. Accordingly, in this embodiment, M2 is selected in a manner providing for acceptable control stability, as a function of M1, as illustrated in the two-dimensional calibration table of FIG. 4. More specifically, with M1 and M2 representing transient fuel compensation coefficients, M2 is set to actual impact factor K1 for M1 of unity or less as indicated by curve portion 402 until the overdamped limit boundary 404 is reached (at which M1=M2) and thereafter to remain at the overdamped boundary as illustrated by curve portion 400 as M1 decreases with increasing film 26 (FIG. 1) temperature Tf, as Tf is determined to be the dominant transient effect on the value of M1. As such, the unstable compensation region 410 of FIG. 4 as well as the underdamped boundary 406 are avoided to provide for fueling control robustness. In this embodiment, actual impact factor K1 is determined by averaging the measured impact factors from several automated tests into a single value.

Returning to FIG. 2, after selecting an appropriate value for M2 at the step 228, the mass of fuel vapor Mfl that has left the film for the current active cylinder since the most recent prior estimation of fuel film mass for that cylinder is estimated at a next step 232 as follows:

$$Mfl = mf(1 - M1)$$

in which mf is the film mass of the current cylinder that exists before the injection of fuel for the current cycle. A compensated fuel command Mfi for the current active cylinder is next generated at a step 240 which compensates for the fuel vapor leaving the fuel film and passing to the active cylinder during its intake event for combustion therein, as follows:

$$Mfi = \frac{mfc - Mfl}{1 - M2}$$

in which mfc is the base fuel command determined at the step 216 and Mfl is the fuel vapor that left the fuel film during the last cycle while the intake valve was closed as determined at the step 232. The compensation may result in an increase or decrease in the base fuel command generated at the step 216. For example, for an initial portion of a tip-in maneuver in which engine load and fueling rate are increasing, the command will be increased, augmenting the fueling command to account for a build-up of the fuel film on the intake system of the cylinder 14 of the cylinder, such as cylinder 14 of FIG. 1, and for an initial portion of a tip-out maneuver in which engine load and fueling rate are decreasing rapidly, the command will be decreased, reducing the magnitude of the fueling command to account for the reduction of fuel film mass on the intake system of the cylinder 14 of FIG. 1.

The fuel film mass is then updated at a next step 242 to account for the compensated fuel command that will be delivered at the end of the current event, as follows:

$$Mf_k = M1 * Mf_{k-1} + M2 * Mfi.$$

The compensated fuel command Mfi is next output at a step 244 as command FUEL, for example in the form of a drive pulse, to the drive circuitry 24 of FIG. 1 for driving fuel injector 22 to an open position for the duration of the pulse, as described. Indexed parameters designated with an index of "k", such as $Mf_k$ and $Mfi_k$ are next stored with an updated index of "k−1" at a next step 248 to prepare for the next iteration of the operations of FIG. 2. Following the step 248, the operations of FIG. 2 are concluded and execution of operations that may have been suspended to allow for execution of the operations of FIG. 2 following the described cylinder event-based interrupt, is resumed by returning to such operations via a next step 252. Such operations may include standard background operations that are repeatedly executed while the controller 30 of FIG. 1 is active and while no interrupt service operations are being executed, such as the operations of FIG. 2 or, for a timer-based interrupt the operations of FIG. 3.

Referring to FIG. 3, operations to service a timer event-interrupt, such as an interrupt that occurs approximately every one thousand milliseconds while the controller 30 is active, are illustrated in a step by step manner, as may be implemented in the form of a sequence of software instructions stored in a standard read only memory device (not shown) of the controller 30 of FIG. 1. The operations of FIG. 3 include valve temperature estimation operations and any other conventional operations that may be preferably carried out every one thousand, or a multiple thereof milliseconds, while the controller 30 of FIG. 1 is operating. More specifically, upon occurrence of the one thousand millisecond timer-based interrupt, the operations of FIG. 3 are initiated beginning at a step 300 and proceeding to reference stored parameter values representing the current state of engine operating parameters at a next step 302, including the described engine speed and poppet temperature states. A cylinder mass airflow rate $M_{air}$ is next referenced from a standard memory device of controller 30 at a next step 306. The stored cylinder mass airflow rate is periodically updated through execution of any suitable conventional estimation procedure (not shown) as is generally understood in the engine control art, for example as a function of engine intake airflow rate, engine speed, and the number of cylinders of the engine. A valve temperature estimate is next updated, typically at a one second update rate, at a step 310 as follows:

$$Tv_k = Tv_{k-1} + \left(K2 + K3 \cdot \dot{M}_{air} - \frac{Tv_{k-1}}{K4 + K5 \cdot \dot{M}_{air}}\right)\Delta t$$

in which K2 is an empirical coefficient determined through a conventional automated model-fitting calibration procedure to account for a heating rate offset of the intake valve poppet 16 (FIG. 1), K3 is an empirical coefficient determined through a Levenberg-Marquardt non-linear least squares model-fitting calibration procedure to account for valve heating rate—air mass flow dependency, K4 is an empirical coefficient determined through a conventional automated model-fitting calibration procedure to account for an intake valve temperature time constant offset at low flow rates, and K5 is an empirical coefficient determined through a conventional automated model-fitting calibration procedure to account for intake valve temperature time-constant flow rate dependency. In the calibration procedure, air mass flow rate and intake valve seat temperature are measured as an engine is warmed up at a fixed engine speed and intake air mass flow rate. Three speed/load data-sets that span the engine operating range are processed by an off-line auto-calibration algorithm which fits the model in the valve temperature equation with a conventional nonlinear least-squares optimization algorithm by manipulating coefficients K2, K3, K4, and K5.

After carrying out the valve temperature update of step 310, Tv is stored in a standard random access memory device of controller 30 of FIG. 1 at a next step 312, and the operations of FIG. 3 continue, via a next step 314, to execute any additional operations that may be required in the current timer-based interrupt, such as additional control, diagnostic or maintenance operations generally known in the art. Upon completion of such additional operations, the servicing of the timer-based interrupt is complete and any interrupt operations may be resumed, such as standard low priority background operations.

The preferred embodiment is not intended to limit or restrict the invention since many modifications may be made through the exercise of ordinary skill in the art without departing from the scope of the invention.

The embodiments of the invention in which a property or privilege is claimed are described as follows:

1. A method for controlling a ratio of fuel to air drawn into an internal combustion engine cylinder through a cylinder intake system including an intake port and an intake valve, when the intake valve is driven away from a sealed position at the intake port during a cylinder intake event, comprising the steps of:

estimating a mass of fuel accumulating on the intake system;

providing a convection model for modeling the time rate of change in the mass of fuel accumulating on the intake system through convection;

estimating intake valve temperature;

applying the estimated intake valve temperature to the provided convection model to generate an estimate of the time rate of change in the mass of fuel;

generating a base fueling command;

compensating the base fueling command for change in the mass of fuel accumulating on the intake system by adjusting the base fueling command as a predetermined function of the estimated time rate of change; and controlling fueling to the cylinder in accordance with the compensated base fueling command.

2. The method of claim 1, further comprising the step of:

estimating the mass flow rate of air through the intake system;

and wherein the step of estimating valve temperature estimates valve temperature as a function of the estimated mass flow rate of air through the intake system.

3. The method of claim 1, further comprising the step of:

estimating the mass flow rate of air in proximity to the mass of fuel accumulating on the intake system;

and wherein the applying step applies the estimated intake valve temperature and the estimated mass flow rate of air to the provided convection model to generate an estimate of the time rate of change in the mass of fuel.

4. The method of claim 1, further comprising the step of:

estimating temperature of gasses flowing in proximity to the mass of fuel accumulating on the intake system;

and wherein the applying step applies the estimated intake valve temperature and the estimated temperature of gasses to the provided convection model to generate an estimate of the time rate of change in the mass of fuel.

5. The method of claim 1, the intake system further including an intake manifold, the method further comprising the step of:

estimating absolute air pressure in the intake manifold, and wherein the applying step applies the estimated intake valve temperature and the estimated absolute air pressure to the provided convection model to generate an estimate of the time rate of change in the mass of fuel.

6. A method for controlling a mass of fuel delivered to a cylinder of an internal combustion engine for combustion therein, the cylinder having an intake system including an intake runner with a fuel injector therein, a cylinder intake port, and a valve sealingly seated on the intake port, the intake runner opening across the intake port into the cylinder during cylinder intake events while the valve is driven away from the intake port, the method comprising, for a cylinder intake event preceded by a fuel injection event, the steps of:

estimating cylinder intake air mass;

generating a base fuel command for the fuel injection event as a function of the estimated cylinder intake air mass;

predicting fuel film mass on the intake system prior to the fuel injection event;

estimating intake valve temperature;

providing a convection model for modeling the time rate of change in the predicted fuel film mass through convection as a function of intake valve temperature;

applying the estimated intake valve temperature to the provided model to estimate the time rate of change in fuel film mass;

adjusting the base fuel command in accordance with the estimated time rate of change; and controlling the fuel injector to inject a mass of fuel consistent with the adjusted base fuel command.

7. The method of claim 6, wherein the provided convection model models the time rate of change in the fuel film mass through convection as a function of intake valve temperature and of flow rate of air passing in proximity to the fuel film mass, the method further comprising the step of:

estimating flow rate of air passing in proximity to the fuel film mass, and wherein the applying step applies the estimated intake valve temperature and the estimated flow rate of air to the provided convection model to estimate the time rate of change in fuel film mass.

8. The method of claim 6, wherein the provided convection model models the time rate of change in the fuel film mass through convection as a function of intake valve temperature and temperature of gasses flowing in proximity to the fuel film mass, the method further comprising the step of:

estimating temperature of gasses flowing in proximity to the fuel film mass, and wherein the applying step applies the estimated intake valve temperature and estimated temperature of gasses to the provided convection model to estimate the time rate of change in fuel film mass.

9. The method of claim 6, the engine including an engine intake manifold opening into the intake system, and wherein the provided convection model models the time rate of change in the fuel film mass through convection as a function of intake valve temperature and engine intake manifold absolute air pressure, the method further comprising the step of:

estimating absolute air pressure in the engine intake manifold, and wherein the applying step applies the estimated intake valve temperature and estimated absolute air pressure in the engine intake manifold to the provided convection model to estimate the time rate of change in the fuel film mass.

10. The method of claim 6, further comprising the step of:

estimating air mass flow rate through the intake system;

and wherein the step of estimating intake valve temperature estimates intake valve temperature as a function of the estimated air mass flow rate.

11. The method of claim 6, further comprising the steps of:

generating a control stability limit as a function of the predicted fuel film mass on the intake system prior to the fuel injection event; and selecting an impact factor representing a portion of the injected fuel impacting an intake system component as a function of the generated control stability limit;

and wherein the predicting step predicts the fuel film mass on the intake system as a function of the selected impact factor.

* * * * *